US009375722B2

(12) United States Patent
Fernandez

(10) Patent No.: US 9,375,722 B2
(45) Date of Patent: Jun. 28, 2016

(54) WEAR PLATE SYSTEM, ARRANGEMENT AND METHOD

(75) Inventor: Ricardo Francisco Doberti Fernandez, Santiago (CL)

(73) Assignee: VULCO S.A., Santiago (CL)

( * ) Notice: Subject to any disclaimer, the term of this patent is extended or adjusted under 35 U.S.C. 154(b) by 620 days.

(21) Appl. No.: 13/642,500

(22) PCT Filed: Apr. 19, 2011

(86) PCT No.: PCT/AU2011/000443

§ 371 (c)(1), (2), (4) Date: Dec. 28, 2012

(87) PCT Pub. No.: WO2011/130781

PCT Pub. Date: Oct. 27, 2011

(65) Prior Publication Data

US 2013/0105609 A1 May 2, 2013

(30) Foreign Application Priority Data

Apr. 19, 2010 (CL) ..... 385-2010
Jul. 22, 2010 (AU) ..... 2010903278

(51) Int. Cl.
*B02C 17/22* (2006.01)
*B02C 17/18* (2006.01)

(52) U.S. Cl.
CPC ..... *B02C 17/225* (2013.01); *B02C 17/1855* (2013.01); *B02C 2210/01* (2013.01); *B02C 2210/02* (2013.01); *Y10T 29/49948* (2015.01)

(58) Field of Classification Search
CPC .. B02C 17/22; B02C 17/225; B02C 2210/01; B02C 2210/02
USPC ..... 241/182, 183, 300
See application file for complete search history.

(56) References Cited

U.S. PATENT DOCUMENTS

| | | | | | |
|---|---|---|---|---|---|
| 1,601,956 | A | * | 10/1926 | Gammeter | 241/102 |
| 2,058,257 | A | * | 10/1936 | Porteous | 241/102 |
| 2,820,499 | A | | 1/1958 | Schaaf | |
| 3,804,346 | A | | 4/1974 | Norman | |
| 3,883,080 | A | * | 5/1975 | Andersson | 241/182 |

(Continued)

FOREIGN PATENT DOCUMENTS

| | | | |
|---|---|---|---|
| AU | 557151 | B2 | 12/1986 |
| AU | 200210025 | A1 | 2/2002 |

(Continued)

OTHER PUBLICATIONS

Translation of WO2009094705. Faulkner et al. Apertures of a Grate Element for a Grinding Mill.*

(Continued)

*Primary Examiner* — Faye Francis
*Assistant Examiner* — Onekki Jolly
(74) *Attorney, Agent, or Firm* — Gardere Wynne Sewell LLP

(57) ABSTRACT

A wear plate for a grinding mill discharge head comprises a support structure adapted to secure to a wall of the grinding mill. An opening is defined in the support structure for registration with a corresponding opening in the mill wall. The wear plate further comprises an elastomeric body comprising at least one discharge hole extending there through, the body being adapted to overlay the support structure such that a discharge end of the hole is spaced inwardly of an edge of the support structure opening.

24 Claims, 7 Drawing Sheets

(56) References Cited

U.S. PATENT DOCUMENTS

| | | | | |
|---|---|---|---|---|
| 4,141,511 | A * | 2/1979 | Anderson | 241/183 |
| 4,235,386 | A | 11/1980 | Larsen | |
| 4,289,279 | A * | 9/1981 | Brandt | 241/102 |
| 4,394,982 | A | 7/1983 | Wilson | |
| 4,583,575 | A | 4/1986 | Lundmark | |
| 4,609,158 | A | 9/1986 | Wilson | |
| 5,037,258 | A | 8/1991 | Heurteux | |
| 5,752,665 | A | 5/1998 | Wason | |
| 5,950,944 | A | 9/1999 | Larsen | |
| 6,082,646 | A | 7/2000 | Clarke et al. | |
| 2005/0082403 | A1 | 4/2005 | Boast | |
| 2008/0265074 | A1 * | 10/2008 | Melo et al. | 241/299 |
| 2010/0025512 | A1 * | 2/2010 | Liimatainen et al. | 241/300 |
| 2010/0233420 | A1 | 9/2010 | Ghosh et al. | |
| 2013/0140387 | A1 | 6/2013 | Fernandez | |

FOREIGN PATENT DOCUMENTS

| | | | |
|---|---|---|---|
| CL | 0162-1993 | | 2/1992 |
| CL | 0705-1997 | | 4/1997 |
| CL | 3043-2005 | | 12/2004 |
| CL | 1425-2006 | | 6/2005 |
| CL | 2008-2008 | | 7/2007 |
| CL | 1153-2009 | | 5/2009 |
| CL | 1661-2009 | | 7/2009 |
| CL | 1662-2009 | | 7/2009 |
| CL | 0359-2010 | | 4/2010 |
| CL | 0385-2010 | | 4/2010 |
| CL | 2053-2009 | | 11/2011 |
| CL | 0102-2005 | | 3/2012 |
| CN | 2288009 | Y | 8/1998 |
| CN | 2292609 | Y | 9/1998 |
| CN | 1846867 | A | 10/2006 |
| CN | 101107076 | A | 1/2008 |
| DE | 10047095 | A1 | 4/2002 |
| FR | 2615410 | | 11/1988 |
| GB | 1431618 | A | 4/1976 |
| SU | 635311 | A1 | 11/1978 |
| SU | 1230682 | A1 | 5/1986 |
| WO | WO-2005/087378 | A1 | 9/2005 |
| WO | WO-2009/094705 | A1 | 8/2009 |
| WO | WO-2011/130782 | A1 | 10/2011 |

OTHER PUBLICATIONS

Translation of WO2005087378. Dale, Coray. Grate System.*
U.S. Appl. No. 13/642,508; Office Action dated Feb. 4, 2015.
U.S. Appl. No. 13/642,508; Response to Office Action dated Jun. 4, 2015.
International Preliminary Report on Patentability of PCT/AU2011/000444 dated Jul. 5, 2012.
Written Opinion of PCT/AU2011/000444 dated Jun. 6, 2011.
International Search Report of PCT/AU2011/000444 dated Jun. 6, 2011.

* cited by examiner

WEAR PLATE SYSTEM, ARRANGEMENT AND METHOD

TECHNICAL FIELD

This disclosure relates to a wear plate for use in a grinding mill and particularly, but by no means exclusively, to a wear plate suitable for protecting a discharge end of an autogenous (AG) or semi-autogenous (SAG) grinding mill.

BACKGROUND

Wear plates are used in the mining industry to protect the interior shell of a grinding mill.

The discharge end of a grinding mill is typically protected with a wear plate (often referred to as a "grate plate" or "wear liner") which incorporates a grouping of discharge holes for allowing ore of a sufficiently processed size to pass through corresponding openings provided in the end of the grinding mill. Conventional wear plate designs are typically formed of a heavy metal plate with the discharge holes extending longitudinally along the length of the plate. However, such conventional plate designs are prone to premature wear and require continuous cleaning due to the through holes becoming blocked during operation. It will be appreciated that frequent wear plate replacement and/or cleaning can greatly impact on the productivity of the mill.

Wear plates have been proposed which incorporate rubber inserts that are better at withstanding abrasion and impact forces than the conventional metal wear plates described above. An example of such a wear plate design is described in French Patent FR2615410 whereby wear plates are provided with one or more centrally located rubber inserts which are press-fitted into a surrounding steel casing. However, such wear plates still require frequent replacement due to the outer casing wearing before the rubber inserts. Another disadvantage with the design disclosed in FR2615410 is that the press-fit fastening arrangement is not appropriate for the substantial forces imparted on the wear plate during operation.

SUMMARY

In a first aspect, embodiments are disclosed of a wear plate for a grinding mill discharge head, the plate comprising:

a support structure adapted to secure to a wall of the grinding mill and having an opening defined therein for registration with a corresponding opening in the mill wall; and an elastomeric body comprising at least one discharge hole extending therethrough, the body adapted to overlay the support structure such that a discharge end of the hole is spaced inwardly of an edge of the support structure opening.

In certain embodiments, the discharge end can be spaced inwardly of the edge by a distance equal to approximately half the greater diameter of the hole.

In certain embodiments, the elastomeric body can comprise a grouping of discharge holes with discharge ends of the peripheral holes within the grouping being spaced inwardly of the edge by approximately half the diameter of the hole.

In certain embodiments, the grouping can comprise discharge holes having one or more of square, rectangular and circular cross section.

In certain embodiments, the discharge holes may have an outwardly diverging sectional profile towards the discharge end.

In certain embodiments, the support structure opening can have one of a square, rectangular and circular edge profile.

In certain embodiments, the elastomeric body can comprise a first portion which overlies the support structure and a second portion adapted to underlay the support structure, the first and second portions meeting adjacent the edge of the support structure opening.

In certain embodiments, the discharge holes may extend through both the first portion and second portion of the elastomeric body.

In certain embodiments, the second portion may have a substantially smaller thickness than the first portion.

In certain embodiments, the support structure can comprise one or more perforations defined therein through which the first and second portions of the elastomeric body communicate.

In certain embodiments, the wear plate may further comprise at least one projection extending from an upper surface of the support structure and wherein the first portion of the elastomeric body is arranged to envelope the at least one projection. In certain embodiments, the projection can comprise a head portion and a shank portion which extends from the upper surface of the support structure, the shank portion being of a narrower cross-sectional dimension than the head portion. In certain embodiments, the at least one projection may be welded to the support structure.

In certain embodiments, the support structure can be a metal or alloy plate. In certain embodiments the plate can be formed of ductile steel.

In certain embodiments, the support plate may further comprise a pair of side walls, a lower surface of each side wall being adapted to contact the mill wall. In certain embodiments the second portion of the elastomeric body can at least partially cover an outer surface of the side walls.

In certain embodiments, the wear plate can further comprise a plurality of laterally spaced cross bars which extend between and are supported by the side walls. In certain embodiments the wear plate can further comprise a lifting projection extending upwardly from at least one of the cross bars, such that the elastomeric body is formed over the cross bars and at least one lifting projection to define a wear surface incorporating a lifter bar.

In certain embodiments, at least one of the cross bar and lifting projection is formed from an abrasion resistant metal or metal alloy. In certain embodiments, each cross bar may be approximately 50 millimeters thick. In certain embodiments, the cross bars may be laterally spaced apart by a distance of between 20 to 30 millimeters. In one particular embodiment, the cross bars are laterally spaced apart by a distance of 25 millimeters.

In certain embodiments, the wear plate can further comprise a plurality of bolt holes defined in the support structure adapted to receive a shaft of a bolt for securing the wear plate to the mill wall.

In certain embodiments, the elastomeric body may be formed of rubber.

In a second aspect, embodiments are disclosed of a grinding mill having an end discharge wall on which is secured one or more wear plates in accordance with the first aspect.

In a third aspect, embodiments are disclosed of a method of manufacturing a wear plate comprising:

providing a support structure adapted to secure to a wall of the grinding mill and having an opening defined therein for registration with a corresponding opening in the mill wall; and moulding an elastomeric body comprising at least one discharge hole extending therethrough over the support structure, such that a discharge end of the hole is spaced inwardly of an edge of the support structure opening.

In certain embodiments, the method can further comprise the step of subjecting the elastomeric body to a vulcanization process.

In certain embodiments of the method of the third aspect, the wear plate can be the wear plate of the first aspect.

In a fourth aspect, embodiments are disclosed of a method of fitting a wear plate in accordance with the first aspect, to a mill wall, the method comprising passing one or more bolts anchored to the wear plate through corresponding bolt holes in the mill wall and tightening nuts over threaded ends of the bolts from the outside of the mill wall.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

DETAILED DESCRIPTION

Embodiments will hereafter be described in the context of a wear plate for a grinding mill discharge end wall. It will be understood, however, that embodiments are not so limited and may be adapted for use on other parts of the grinding mill inner shell, including the rotating drum wall.

With reference to FIGS. 1 to 4, a wear plate 10 in accordance with one embodiment comprises a support structure in the form of a metal plate 12 (hereafter "support plate") adapted to mount to a discharge wall of a grinding mill. The support plate 12 has a generally rectangular profile and is formed of ductile steel for suitably conforming to a section of the wall on which it is to be mounted.

Figure 3:
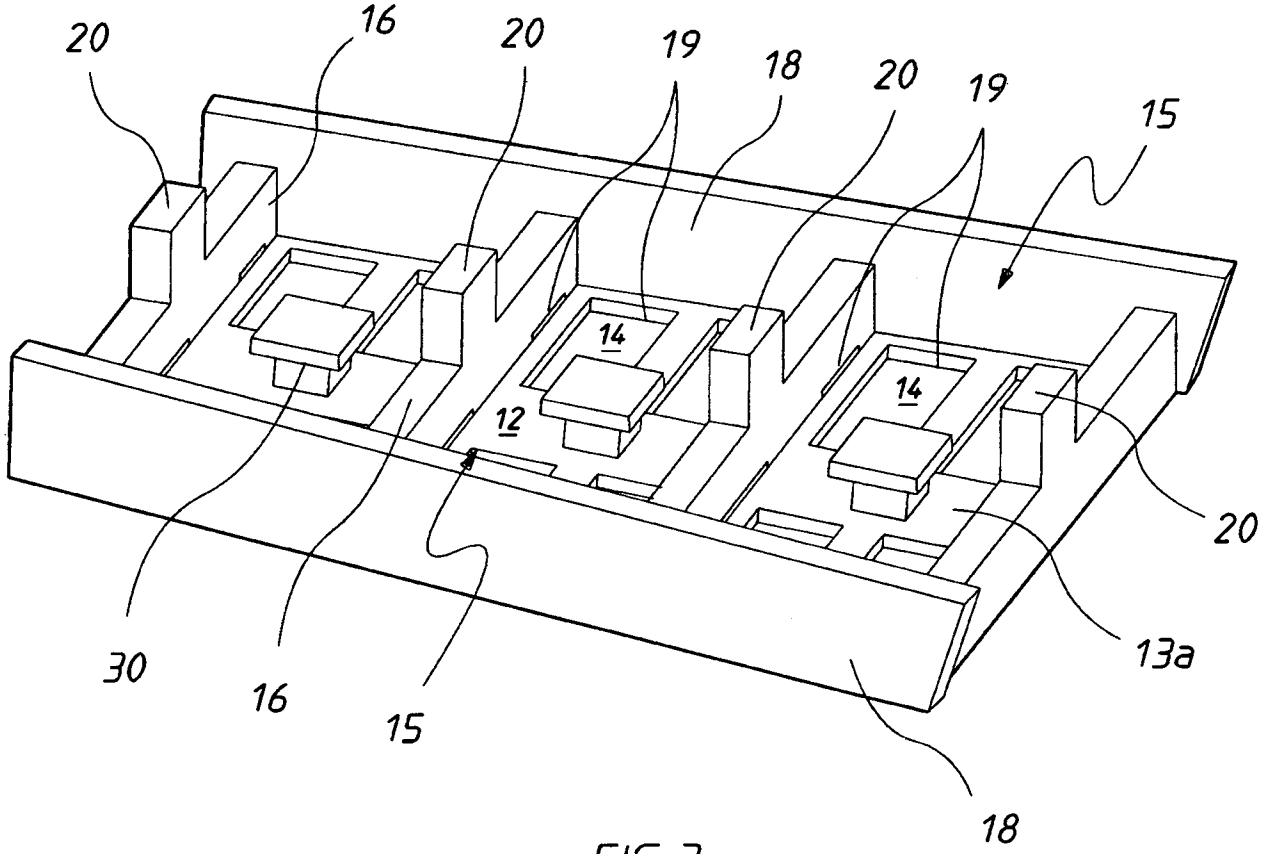
FIG. 3 is a front perspective view of the wear plate of FIG. 1, without the elastomeric body attached.

As is best shown in FIG. 3, the support plate 12 has one or more openings in the form of rectangular open zones 14 defined therein. The plate 12 is secured to the discharge wall such that the open zones 14 are in registration with corresponding openings defined in the mill wall (not shown). In the illustrated embodiment, the wear plate 10 comprises several groupings 15 of the rectangular open zones 14. The groupings 15 are separated by laterally spaced cross bars 16 which extend between, and are supported by, a pair of side walls 18 running longitudinally along each side of the support plate 12. It will be understood that the cross bars 16 may advantageously transfer bending moment forces experienced by the wear plate 10 to its structural edges, improving the overall strength of the wear plate 10.

The side walls 18 may be formed from the same metal sheet as the support plate 12, with the underneath surface 13*b* arranged to contact the mill wall. The cross bars 16 are formed of an abrasion resistant metal or metal alloy and, according to the illustrated embodiment, are 50 millimeters thick and laterally spaced apart by a distance of between 20 to 30 millimeters. Preferably, for the wear plate design shown in the Figures, the cross bars 16 are spaced apart by a distance of 25 millimeters which, through extensive testing, has been found to be suitable for withstanding unwanted rocking and wear in the lifter bar structure (as will be described in more detail in subsequent paragraphs). It will be understood, however, that the thickness, spacing and abrasion resistant material may vary depending on the desired application.

As is also evident from FIG. 3, the cross bars 16 are provided with centrally located lifting projections 20 formed of an abrasion resistant material and which together form the support structure of a lifter bar 22, as will be described in more detail in subsequent paragraphs. The lifting projections 20 may be integrally formed with the cross bars 16, or alternatively may be welded or otherwise affixed to the cross bars 16. In an alternative embodiment to that illustrated in FIG. 3, the lifting projections 20 may alternatively or additionally couple to and extend from a central region of the support plate 12 located between the cross bars 16.

Figure 1:
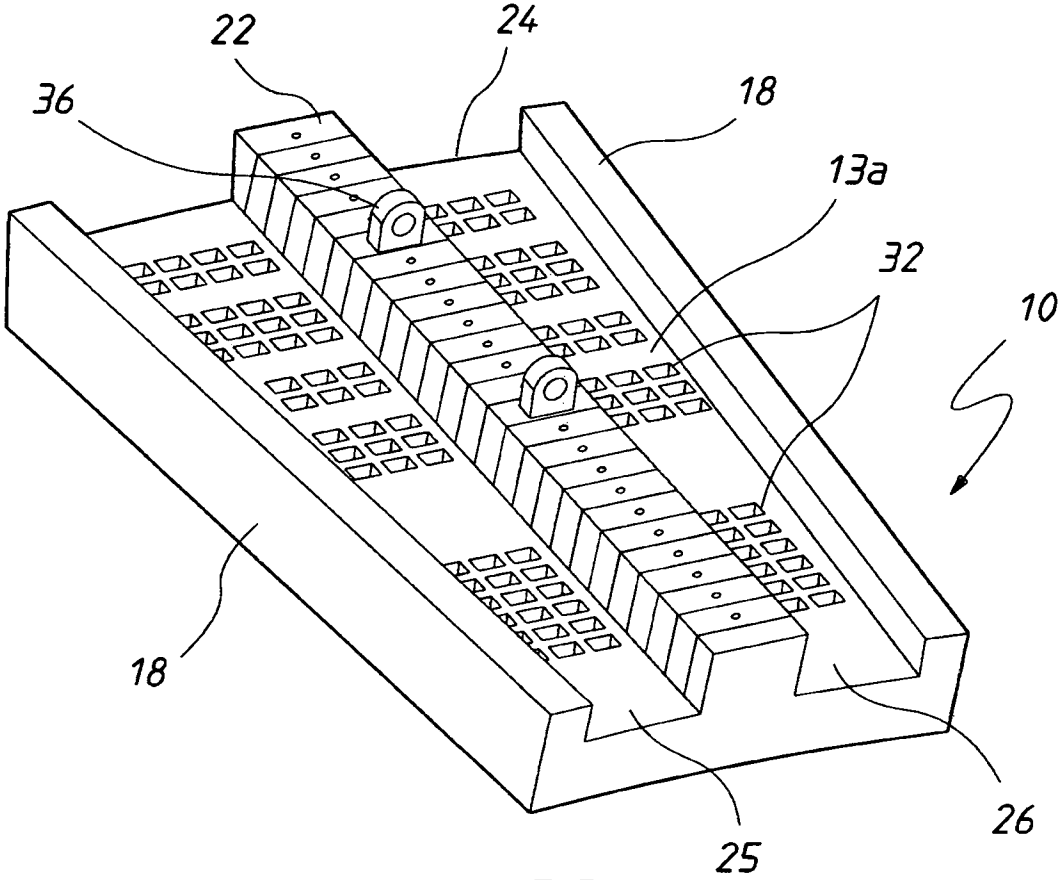
FIG. 1 is a front perspective view of an assembled wear plate in accordance with an embodiment.
Figure 2:
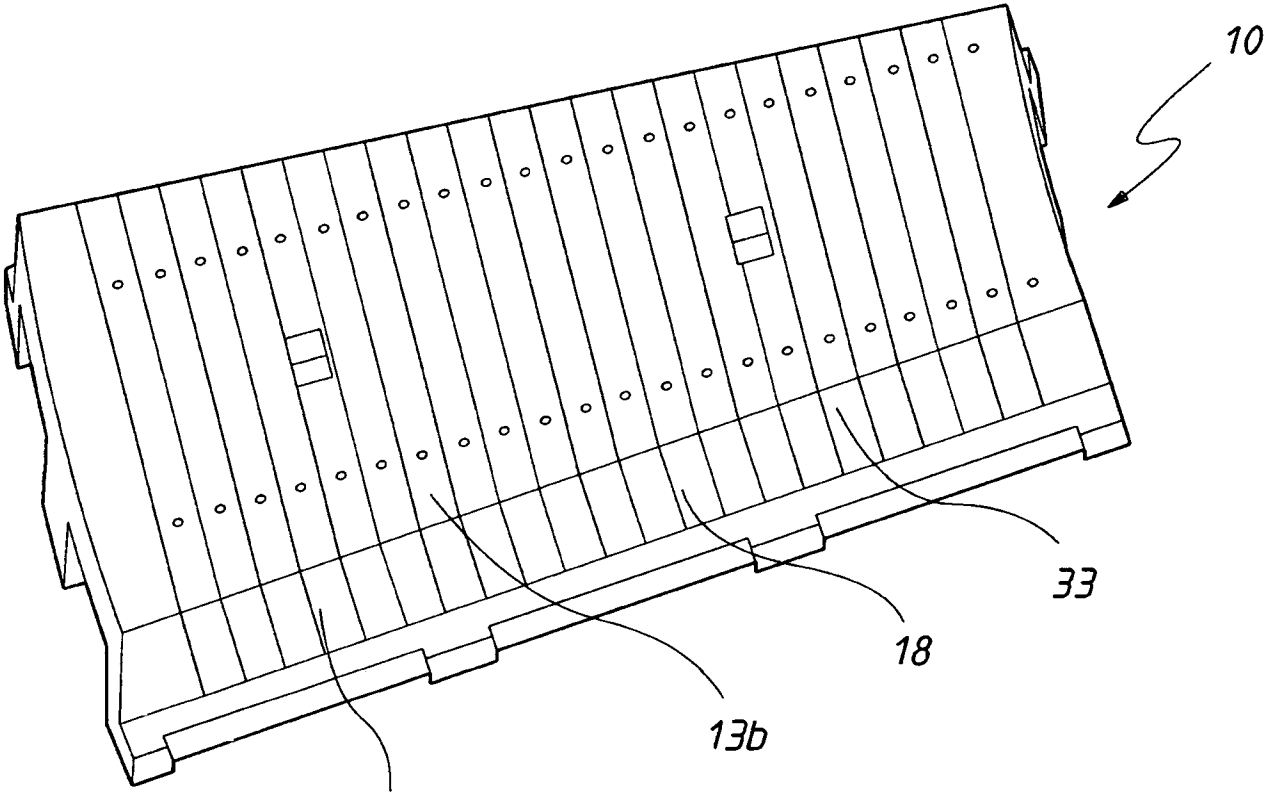
FIG. 2 is a rear perspective view of the wear plate of FIG. 1.

With particular reference to FIGS. 1 and 2, the wear plate 10 further comprises an elastomeric body in the form of a rubber block 24. The rubber block 24 has a first portion 26 which overlays the support plate 12 to form a wear surface 25 incorporating a lifter bar 22 as shown particularly in FIG. 1. A substantially thinner second portion 27 underlies the plate 12, as best shown in FIG. 2. According to the illustrated embodiment, the first and second portions 26, 27 are moulded over the plate 12 and subjected to vulcanization. Preferably, the thinner rubber coating of the second portion 26 extends over each of the side walls 18 such that the plate 12 is wholly covered by a rubber layer.

To further assist in securing the rubber block 24 to the support plate 12, one or more perforations may be provided in the support plate 12 which allow the vulcanised rubber block 24 to better grip the plate 12. Such a design may advantageously place the lower side of the plate 12 in tension and the upper side in compression, which may better withstand the substantial impact forces imparted on the wear plate during operation. As an alternative or additional securing technique, at least one securing projection extends from the upper surface 13*a* of the support plate 12 which is arranged to be enveloped by the rubber block 24. In the illustrated embodiment the securing projection is in the form of a T-shaped boss 30 which is welded to the upper surface 13*a* and centrally located between each grouping of open zones 14.

A plurality of discharge holes in the form of rectangular apertures 32 extend through the rubber block 24 for permitting ore of a sufficiently processed size to pass through the openings in the discharge wall. The apertures 32 have an outwardly diverging sectional profile towards their discharge end 33 for minimising blocking. According to the illustrated embodiment, the rectangular apertures 32 are arranged in groups corresponding to the rectangular open zones 14 provided in the support plate 12. The discharge end 33 of the peripheral apertures 32 within each grouping is spaced inwardly of an edge 19 of the corresponding open zone 14. In the illustrated embodiment, the distance is equal to approximately half the length of the rectangular aperture 32 which, through extensive testing, has been found to provide a suitably controlled flexibility for the rubber block 24. It will be understood that, for alternative aperture shapes (obround, triangular, square, circular, etc.), the distance will be equal to half the greater diameter of the aperture.

Figure 4:
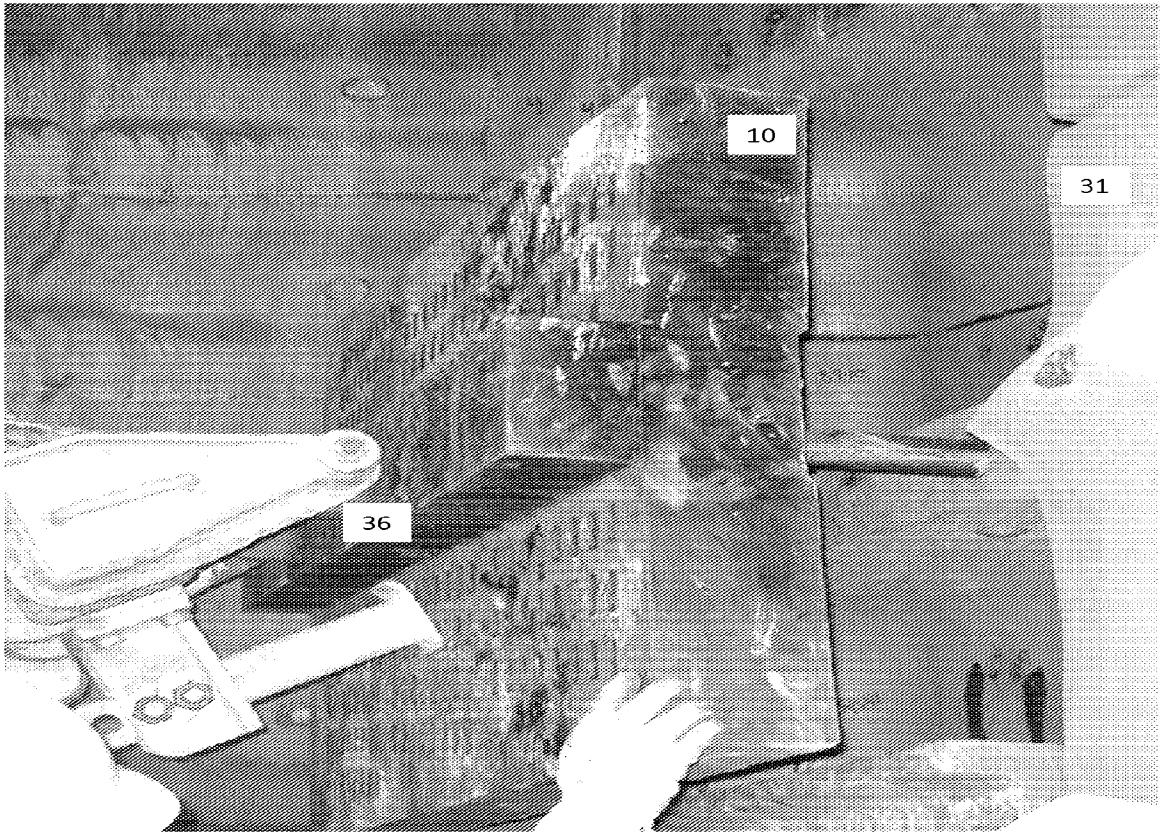
FIG. 4 is a diagram illustrating installation of the wear plate of FIG. 1 on a grinding mill discharge end wall.
Figure 5:
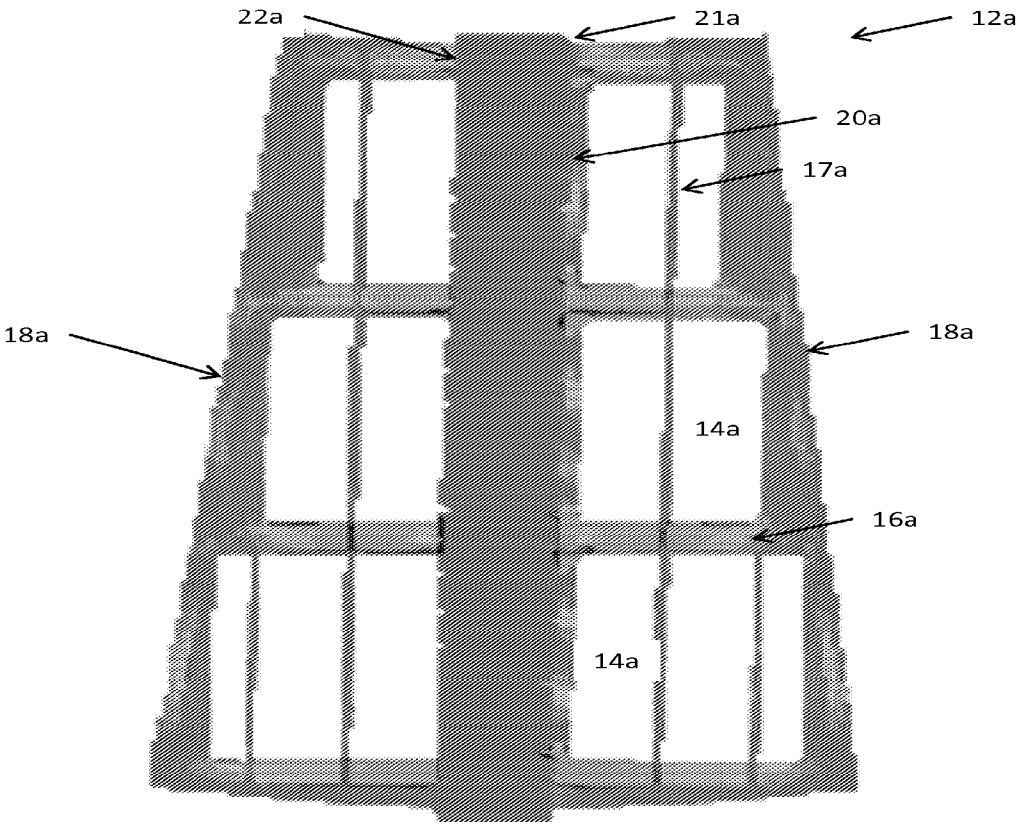
FIG. 5 is a front view of a wear plate support structure, in accordance with a further embodiment.
Figure 6A:
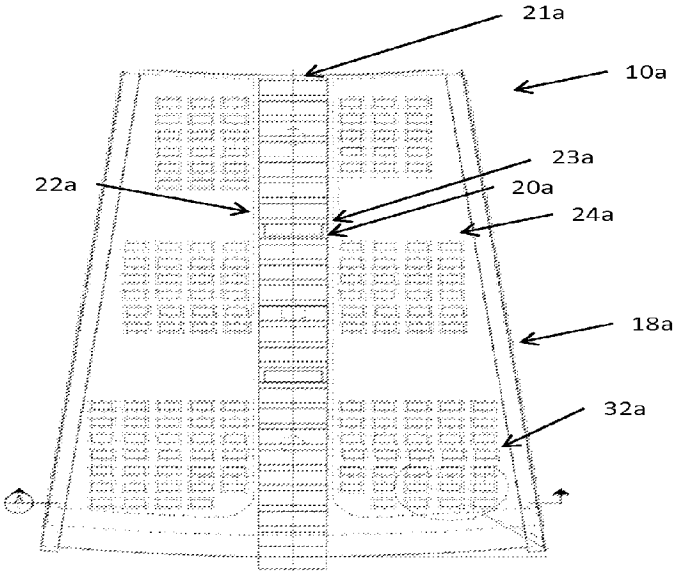
FIGS. 6*a* and 6*b* are front view and sectional end views respectively, of an assembled wear plate incorporating the wear plate support of FIG. 5.
Figure 6B:
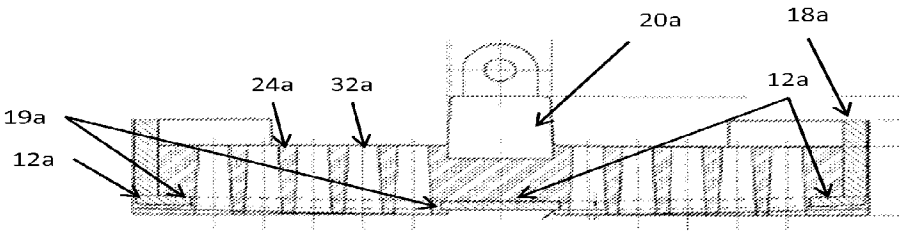

During assembly, the wear plate 10 is pressed against the desired section of the mill wall and secured thereto by one or more bolts. The bolt heads may be anchored to the support plate 12, for example by moulding the rubber body 24 over the bolt heads (which in one embodiment may be located on the upper surface 13*a* of the plate 12 with the bolt shaft extending through a corresponding bolt hole provided in the plate 12). A nut is then tightened over a threaded end of the bolt shaft which extends through the mill wall such that, when tightened, the side walls 18 are tightly secured to the wall section. The remainder of the wear plate 10, by virtue of its construction, is deformed until it conforms to the profile of the mill wall. Anchoring of the bolts to the structural plate in the manner described above is advantageous since it facilitates preloading of the bolts, thereby avoiding the need to re-tighten the bolts which is a disadvantage associated with the conventional rubber wear plate designs outlined in the background section. A number of hoisting anchor points 36 formed of ductile steel may be incorporated to facilitate installation and removal of the wear plate. A picture illustrating installation of a wear plate 10 to a mill wall 31 in the manner outlined above is shown in FIG. 4.

An alternative embodiment of a wear plate 10*a* is shown in FIGS. 5 through 8. Parts having a similar functionality to those parts shown in the first embodiment are designated using the same part number but followed with the additional letter "a". According to this alternative embodiment, the support plate 12*a* is formed of a combination of structural and high chrome steel. The plate 12*a* incorporates a number of transverse cross bars 16*a* which extend from the side walls 18*a* and which intersect with longitudinal supports 17*a* and central spine 21*a*, to thereby create the open zones 14*a*. According to the illustrated embodiment, the cross bars 16*a* have a depth which is equivalent to the height of the side walls 18*a* for increasing the structural strength of the wear plate. A plurality of closely spaced lifting projections 20*a* extend from the central spine 21*a*. Like the embodiment shown in FIG. 1, an elastomeric body in the form of a rubber block 24*a* is moulded over the support plate 12*a* and includes a plurality of discharge holes 32*a* which are arranged in groups corresponding to the open zones 14*a* (see particularly FIGS. 6*a* and 6*b*). The peripheral holes are spaced inwardly of one or more edges 19*a* of the open zones 14*a* for support, as is best shown in FIG. 6*b*. Again, a lifter bar 22*a* is formed from a combination of the lifting projections 20*a* and interposed moulded sections 23*a* of the rubber block 24*a*. One or more nuts are secured to (or embedded within) a lower surface of the support plate 12*a* underneath the central spine 21*a* for receiving a threaded end of a bolt shank. In use, an opposing threaded end of the shank passes through the mill wall and a nut is then tightened over the opposing threaded end for securing the wear plate to the desired wall section.

Figure 7:
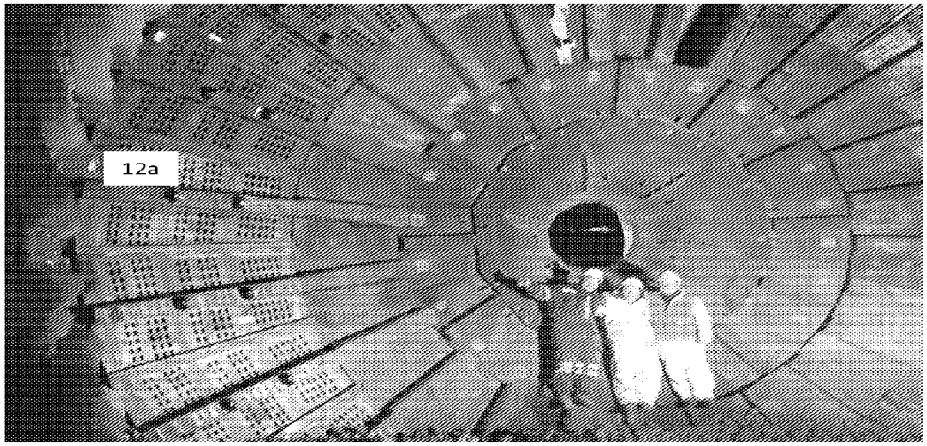
FIG. 7 is a view from inside a grinding mill illustrating an installation of the wear plate of FIGS. 6*a* and 6*b*.
Figure 8:
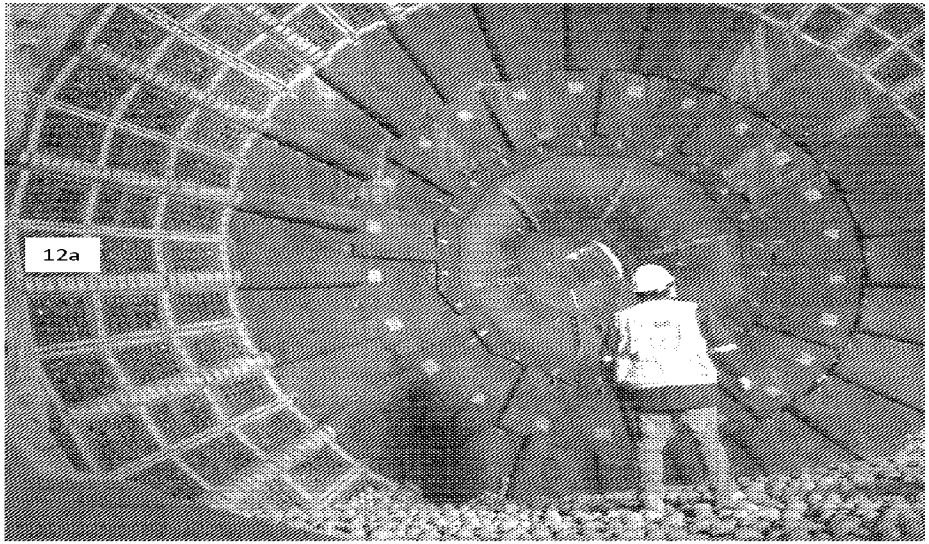
FIG. 8 is a view from inside the grinding mill illustrating the wear plate of FIGS. 6 and 7, after a period of mill operation.

With reference to FIG. 7 there is shown a grinding mill end wall provided with a plurality of newly installed wear plates, in accordance with one or more embodiments of the present invention. FIG. 8 is a picture of the end wall after a period of use, with the wear plates still intact and generally free of blockage.

It will be understood that techniques for securing the rubber block to the support plate 12 other than those described above may equally be suitable for use in further embodiments. For example, in one such alternative embodiment, the rectangular apertures 14 may be formed from overlapping or interlocking metal strips with the elastomeric body adapted to secure to interstices between the overlapping/interlocking strips.

Furthermore, it will be understood by persons skilled in the art the open zones 14 may not be rectangular but instead have square, obroad, circular or other desired geometries depending on the application and shape of the openings in the mill wall. Equally, the groupings of discharge apertures may take on any particular shape to conform to the open zone geometry.

It can be seen that certain embodiments have at least one or more of the following advantages:

- light weight design as a result of the wear plate body being formed primarily of elastomeric material, resulting in increased worker safety and reduced replacement times
- Robust design resulting from underlying plate support structure
- Ductile metal support structure conforms easily to contours of mill wall
- Elastomeric bottom layer seals interstices, prevents build of up fines and generally facilitates wear plate removal
- Discharge hole design minimises potential for plugging
- Spacing between discharge hole ends and support plate openings provides controlled flexibility in the hole zone while minimising the likelihood of early failure through separation of the elastomeric body from the support plate caused from excessive deformation of the elastomeric body
- Predictable wear plate behaviour reduces the need for regular inspections and allows for scheduled wear plate maintenance and replacement In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "upper" and "lower", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The invention claimed is:

1. A wear plate for a grinding mill discharge head, the plate comprising:

a support structure adapted to secure to a wall of the grinding mill and having an opening defined therein for registration with a corresponding opening in the mill wall; and an elastomeric body adapted to overlay the support structure and comprising a grouping of discharge holes which extend through the elastomeric body and that pass through the support structure opening for allowing egress of processed grinding mill materials into the grinding mill discharge head, wherein the elastomeric body includes a first portion which overlies the support structure and a second portion adapted to underlay the support structure, and wherein the discharge holes extend through both the first portion and second portion of the elastomeric body.

2. A wear plate in accordance with claim 1, wherein for one or more of the discharge holes within the grouping of discharge holes, a discharge end of such discharge holes is spaced inwardly of an adjacent edge of the support structure opening by approximately half the diameter of the hole.

3. A wear plate in accordance with claim 1, wherein the grouping of discharge holes comprises discharge holes having one or more of a square, a rectangular, and a circular cross section.

4. A wear plate in accordance with claim 2, wherein one or more of the discharge holes of the grouping have an outwardly diverging sectional profile towards the discharge end of such discharge holes.

5. A wear plate in accordance with claim 1, wherein the support structure opening has one of a square, a rectangular, and a circular edge profile.

6. A wear plate in accordance with claim 1, wherein the second portion has a substantially smaller thickness than the first portion.

7. A wear plate in accordance with claim 1, wherein the support structure comprises one or more perforations.

8. A wear plate in accordance with claim 1, further comprising at least one projection extending from an upper surface of the support structure and wherein the first portion of the elastomeric body is arranged to envelope at least a portion of the at least one projection.

9. A wear plate in accordance with claim 8, wherein the projection comprises a head portion and a shank portion which extends from the upper surface of the support structure, the shank portion being of a narrower cross-sectional dimension than the head portion.

10. A wear plate in accordance with claim 8, wherein the at least one projection is welded to the support structure.

11. A wear plate in accordance with claim 1, wherein the support structure is a metal or alloy plate.

12. A wear plate in accordance with claim 11, wherein the plate is formed of ductile steel.

13. A wear plate in accordance with claim 11, wherein the support plate further comprises a pair of side walls, a lower surface of each side wall being adapted to contact the mill wall.

14. A wear plate in accordance with claim 13, wherein the second portion at least partially covers an outer surface of the side walls.

15. A wear plate in accordance with claim 1, further comprising a plurality of laterally spaced cross bars which extend between and are supported by the side walls.

16. A wear plate in accordance with claim 15, further comprising a lifting projection extending upwardly from at least one of the cross bars, such that the elastomeric body is formed over the cross bars and at least one lifting projection to define a wear surface incorporating a lifter bar.

17. A wear plate in accordance with claim 16, wherein at least one of the cross bar and lifting projection is formed from an abrasion resistant metal or metal alloy.

18. A wear plate in accordance with claim 15, wherein each cross bar is approximately 50 millimeters thick.

19. A wear plate in accordance with claim 15, wherein the cross bars are laterally spaced apart by a distance of between about 20 to about 30 millimeters.

20. A wear plate in accordance with claim 19, wherein the cross bars are laterally spaced apart by a distance of about 25 millimeters.

21. A wear plate in accordance with claim 1, further comprising a plurality of bolt holes defined in the support structure adapted to receive a shaft of a bolt for securing the wear plate to the mill wall.

22. A wear plate in accordance with claim 1, wherein the elastomeric body is formed of rubber.

23. A grinding mill having an end discharge wall on which is secured one or more wear plates, the one or more wear plates comprising:

a support structure adapted to secure to the end discharge wall of the grinding mill and having at least one opening defined therein for registration with a corresponding at least one opening in the mill wall; and an elastomeric body overlaying the support structure and comprising a grouping of discharge holes which extend through the elastomeric body and that pass through the support structure of the at least one opening for allowing egress of processed grinding mill materials to the end discharge wall of the grinding mill, wherein the elastomeric body includes a first portion that overlies the support structure and a second portion that underlays the support structure, and wherein the discharge holes extend through both the first portion and second portion of the elastomeric body.

24. A wear plate in accordance with claim 1, further comprising one or more additional openings in the support structure for registration with corresponding openings in the mill wall, and wherein additional discharge hole groupings pass through the respective additional support structure openings for allowing egress of processed grinding mill materials into the grinding mill discharge head.

* * * * *